US012760602B2

(12) United States Patent
Brooks

(10) Patent No.: US 12,760,602 B2
(45) Date of Patent: Oct. 13, 2026

(54) DRILL BIT

(71) Applicant: Zac Andrew Wilson, Red Hill (AU)

(72) Inventor: Nathan Andrew Brooks, Brisbane (AU)

(73) Assignee: Zac Andrew Wilson, Red Hill (AU)

( * ) Notice: Subject to any disclaimer, the term of this patent is extended or adjusted under 35 U.S.C. 154(b) by 146 days.

(21) Appl. No.: 18/003,159

(22) PCT Filed: Jun. 28, 2021

(86) PCT No.: PCT/AU2021/050681
§ 371 (c)(1),
(2) Date: Dec. 23, 2022

(87) PCT Pub. No.: WO2021/258164
PCT Pub. Date: Dec. 30, 2021

(65) Prior Publication Data

US 2023/0287743 A1 Sep. 14, 2023

(30) Foreign Application Priority Data

Jun. 26, 2020 (AU) ..... 2020902145

(51) Int. Cl.
*E21B 10/633* (2006.01)
*E21B 10/43* (2006.01)
*E21B 10/55* (2006.01)

(52) U.S. Cl.
CPC ..... *E21B 10/633* (2013.01); *E21B 10/43* (2013.01); *E21B 10/55* (2013.01)

(58) Field of Classification Search
None
See application file for complete search history.

(56) References Cited

U.S. PATENT DOCUMENTS 1,428,122 A * 9/1922 Smith ..... E21B 10/00 279/101
1,428,137 A * 9/1922 Bookhout ..... E21B 10/00 175/412

(Continued)

FOREIGN PATENT DOCUMENTS

CN 107975343 A 5/2018
EP 3000959 A1 3/2016

(Continued)

OTHER PUBLICATIONS

International Search Report and Written Opinion mailed Oct. 1, 2021, in connection with International Patent Application No. PCT/AU2021/050681, 16 pgs.

(Continued)

*Primary Examiner* — Blake Michener
(74) *Attorney, Agent, or Firm* — Workman Nydegger

(57) ABSTRACT

A drill bit assembly for making a hole in a subterranean formation, the drill bit assembly comprising: a connector body defining a centreline axis about which said connector body rotates while drilling; a plurality of blade members connected to the connector body and circumferentially arranged around the centreline axis to form a cutting blade having an outer diameter generally equal to a desired hole diameter, wherein each blade member comprises at least one aperture for receiving a cutting pin; and a removable sleeve positionable within the at least one aperture, the removable sleeve configured to rotatably engage with the at least one cutting pin to allow the at least one cutting pin to rotate within the removable sleeve when the drill bit assembly operates to make the hole in the subterranean formation.

23 Claims, 11 Drawing Sheets

(56) References Cited

U.S. PATENT DOCUMENTS 2,666,622 A * 1/1954 Hawthorne ..... E21B 10/627 175/391
2,831,657 A * 4/1958 Hawthorne ..... E21B 10/627 175/391
2,978,049 A * 4/1961 Skidmore ..... E21B 10/62 175/391
3,003,570 A * 10/1961 Roland ..... E21B 10/627 175/391
3,099,325 A * 7/1963 Purser, Sr. ..... E21B 10/627 175/391
3,139,946 A * 7/1964 Bronson ..... E21B 10/627 175/391
3,760,894 A * 9/1973 Pitifer ..... E21B 10/633 175/413
5,560,440 A 10/1996 Tibbitts
8,272,458 B2 * 9/2012 Nackerud ..... E21B 10/627 175/416
2009/0308664 A1 * 12/2009 Nackerud ..... E21B 10/627 175/412
2010/0218999 A1 * 9/2010 Jones ..... E21B 10/633 175/413
2019/0360274 A1 11/2019 Tian et al.

FOREIGN PATENT DOCUMENTS

WO 2000/043628 A2 7/2000
WO 2012/148965 A2 11/2012
WO 2019/094912 A1 5/2019
WO WO-2021107979 A1 * 6/2021 ..... E21B 10/08

OTHER PUBLICATIONS

International Preliminary Report on Patentability (Chapter II of the PCT) mailed Oct. 10, 2022, in connection with International Patent Application No. PCT/AU2021/050681, 9 pgs.

* cited by examiner

DRILL BIT

CROSS-REFERENCE TO RELATED APPLICATIONS

This application is a National Stage under 35 U.S.C. 371 of International Patent Application No. PCT/AU2021/050681, filed Jun. 28, 2021, which claims priority from Australian Patent Application No. 2020902145, filed Jun. 26, 2020; the disclosures of all of which are incorporated herein by reference in their entirety.

TECHNICAL FIELD

The present invention relates to an improved drill bit, particularly but not exclusively rotary drill bits that are used in drilling operations.

BACKGROUND

Any references to methods, apparatus or documents of the prior art are not to be taken as constituting any evidence or admission that they formed, or form part of the common general knowledge.

Specialized drill bits are used to drill wellbores, boreholes, and other holes in the earth for a variety of purposes, including water wells, oil and gas wells, injection wells, geothermal wells, monitoring wells, holes used in mining, and the like. These drill bits come in two common types: roller cone drill bits and fixed cutter drill bits.

Well bores and other holes in the earth are typically drilled by attaching or connecting a drill bit to a means of rotating the drill bit. The drill bit can be attached directly to a shaft that is rotated by a motor, engine, drive, or other means of providing torque to rotate the drill bit. In oil and gas drilling, for example, the drill bit is typically connected to the lower end of a drill string that is in turn, connected at the upper end to a motor or drive at the surface, with the motor or drive rotating both the drill string and the drill bit together. The drill string typically comprises several elements that may include a special down-hole motor configured to provide additional or, if a surface motor or drive is not provided, the only means of turning the drill bit.

Rotary drag drill bits, (such as polycrystalline diamond compact, or PDC drill bits) may be used for boring through subterranean rock formations when drilling oil and natural gas wells. The drill bit may include a number of cutting structures, or cutting pins housed within apertures on the cutting surface of the drill bit. The cutting pins are positioned and orientated on the cutting surface so that a portion of each cutting pin engages the earth formation as the drill bit is rotated. As the drill bit rotates the cutting pins also rotate within the apertures as the drill bit drags across the bottom of the well, scraping or shearing the formation. This rotation wears on the sides of the apertures, eventually causing the cutting pins to fall out. The cost to replace the entire drill bit is cumbersome and costly.

Applications that use such drill bits can have varied dimensional requirements. By way of example, drill bits are typically available in several diameter sizes such as 229 mm, 251 mm and 271 mm. Fabrication and manufacturing of drill bits for each of such specific sizes can result in higher manufacturing costs and it is therefore desirable to provide drill bits that allow usage across a range of sizes.

As discussed above, one problem associated with such drill bits relates to excessive wear at the point of engagement of cutting pins, or cutters on the blade surface of such drill bits. Cutters such as gouging cutters comprise a cutter body with a leading tip (typically made from a hard material) that contacts subterranean formations with a trailing mounting post that is directly mounted into engagement within pockets, or apertures provided on the blade surface.

SUMMARY OF INVENTION

In an aspect, the invention provides a drill bit assembly operable for making a hole in a subterranean formation, the drill bit comprising:

- a connector body defining a centerline axis about which said connector body rotates while drilling;
- a plurality of blade members connected to the connector body and circumferentially arranged around the centreline axis to form a cutting blade having an outer diameter generally equal to a desired hole diameter, wherein each blade member comprises at least one aperture for receiving a cutting pin; and
- a removable sleeve, positionable at least partially within the at least one aperture and configured to retain the cutting pin therein.

Preferably, the removable sleeve includes a connecting arrangement for securing the removable sleeve within the aperture.

Still preferably, the connecting arrangement includes an outer threaded surface on the removable sleeve, and an inner threaded surface within the at least one aperture so that the removable sleeve threadingly engages the at least one aperture.

Preferably, the removable sleeve is configured to rotatably engage with the cutting pin to allow the cutting pin to rotate within the removable sleeve when the drill bit assembly operates to make the hole in the subterranean formation.

Preferably, the blade members are configured to nest circumferentially around the centreline axis to form the cutting blade.

Preferably, each blade member includes a first engagement surface and a second engagement surface perpendicular to the first engagement surface, and wherein the blade members are configured so that the first engagement surface of one blade member engages the second engagement surface of an adjacent blade member.

Still preferably, the first engagement surface includes at least one protrusion, and the second engagement surface includes at least one complementary recess for receiving the at least one protrusion for engagement of adjacent blade members.

In one embodiment the outer diameter of the cutting blade is variable by selectively positioning the engagement position of the at least one protrusion relative to at least one complementary recess.

Preferably, the drill bit assembly includes an adaptor for selectively positioning the blade members circumferentially around the centreline axis.

In one embodiment there is provided a drill bit assembly for making a hole in a subterranean formation, the drill bit comprising:

- a connector body defining a centreline axis about which said connector body rotates while drilling; and
- a plurality of blade members connected to the connector body and circumferentially arranged around the centreline axis to form a cutting blade having an outer diameter generally equal to a desired hole diameter, wherein each blade member comprises at least one aperture for receiving a cutting pin; wherein the outer diameter of the cutting blade is variable by selectively positioning the circumferential arrangement of the plurality of blade members.

In one embodiment, the drill bit assembly includes an adaptor coupling the connector body and the blade members, wherein the adaptor positions the blade members to achieve the cutting blade outer diameter.

Preferably, the adaptor includes a plurality of grooves circumferentially spaced apart and configured to receive a respective blade member.

Still preferably, each blade member includes a tongue portion receivable within a respective groove for engagement with the adaptor.

Another embodiment provides, in combination a drill bit assembly and cutting pin operable for making a hole in a subterranean formation, the drill bit comprising:

a connector body defining a centerline axis about which said connector body rotates while drilling;

a plurality of blade members connected to the connector body and circumferentially arranged around the centreline axis to form a cutting blade having an outer diameter generally equal to a desired hole diameter, each blade member having a blade surface comprising at least one aperture; and a removable sleeve positionable within the at least one aperture, the removable sleeve configured to rotatably engage with the cutting pin to allow the cutting pin to rotate within the removable sleeve when the drill bit assembly operates to make the hole in the subterranean formation.

Preferably, the cutting pin includes a leading tip portion formed of at least one of tungsten carbide, diamond impregnated tungsten carbide, cubic boron nitride, polycrystalline diamond.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 18 shows an enlarged detailed view of section B in FIG. 17; and.

DETAILED DESCRIPTION OF PREFERRED EMBODIMENTS

FIGS. 1 to 13 illustrate an embodiment of a drill bit assembly 100 in accordance with the present invention, and FIGS. 14 to 18 illustrate a cutting pin and removable sleeve for use with the drill bit assembly. FIG. 19 illustrates the drill pattern of the drill bit assembly.

Figure 1:
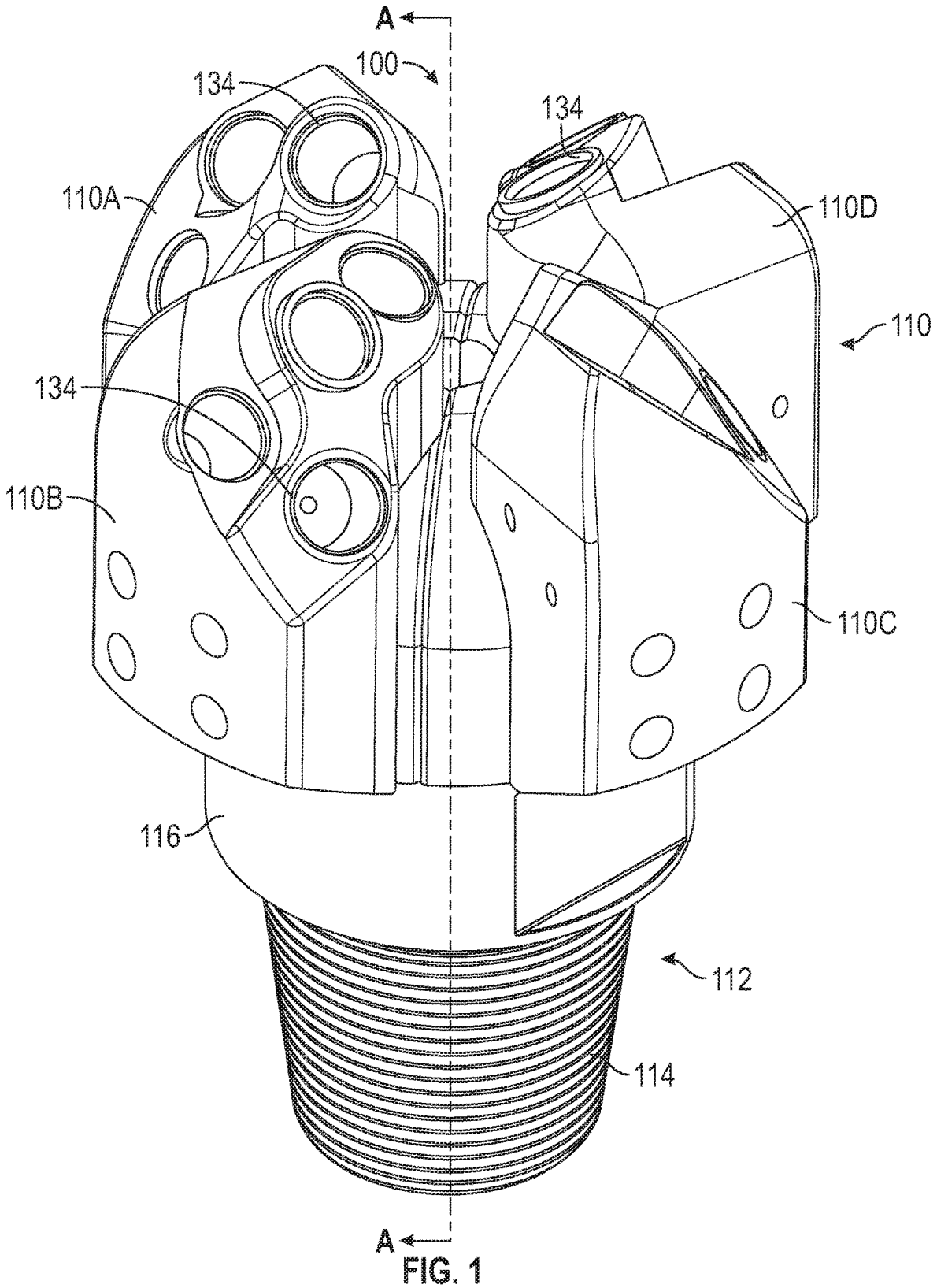
FIG. 1 shows a drill bit assembly in accordance with a first embodiment of the present invention.

Referring to FIG. 1, the drill bit assembly 100 comprises a connector body 112 and a cutting blade 110 having a centreline axis A-A. The cutting blade 110 houses a plurality of removable sleeves 134, and each sleeve 134 is configured to receive a respective cutting pin 124 (shown in FIG. 2). Advantageously, the removable sleeve 134 eliminates the need for replacing the entire cutting blade 110 due to wear or damage around the cutting pin 124.

Figure 2:
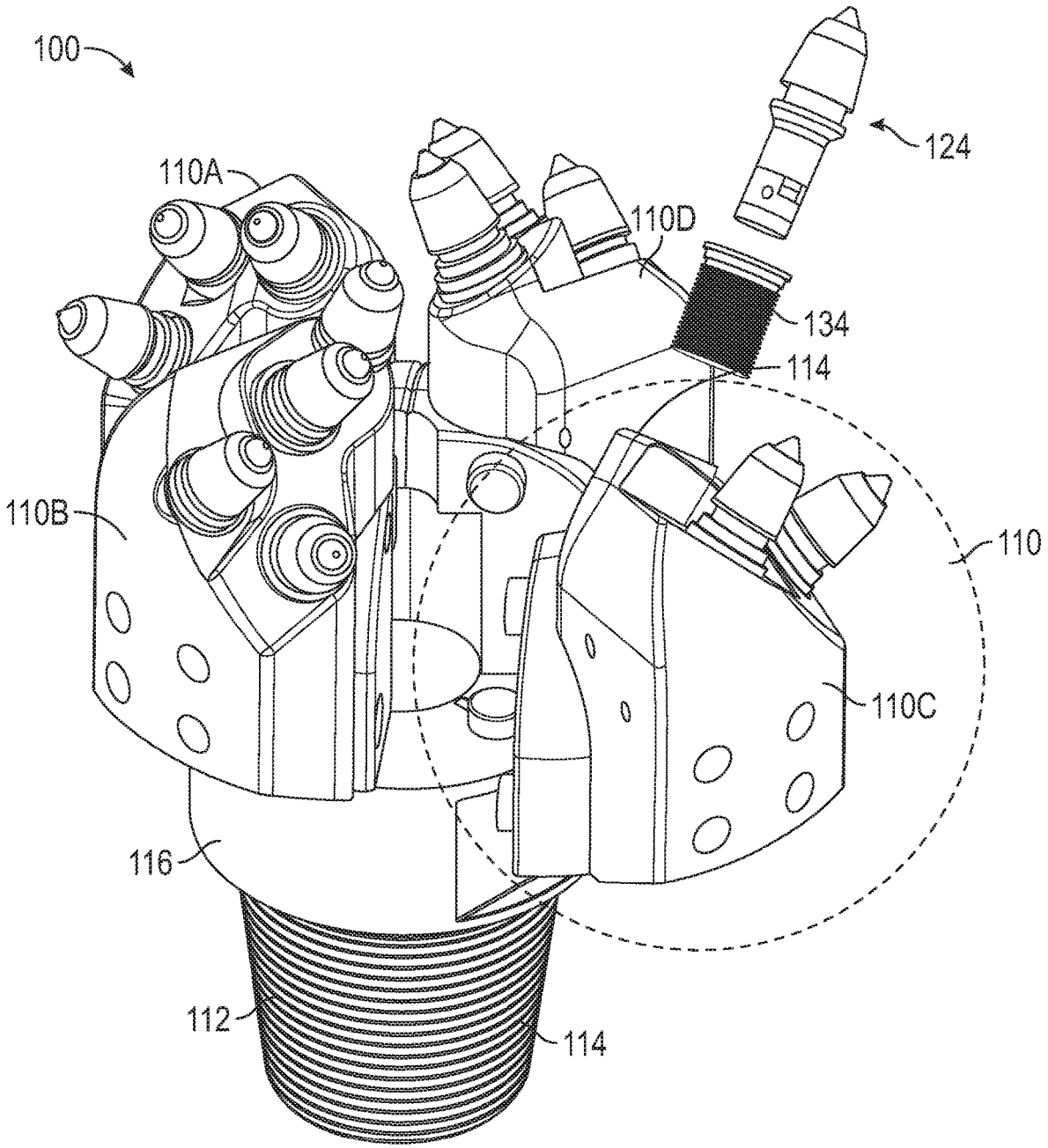
FIG. 2 shows the drill bit assembly of FIG. 1 including cutting pins.
Figure 3:
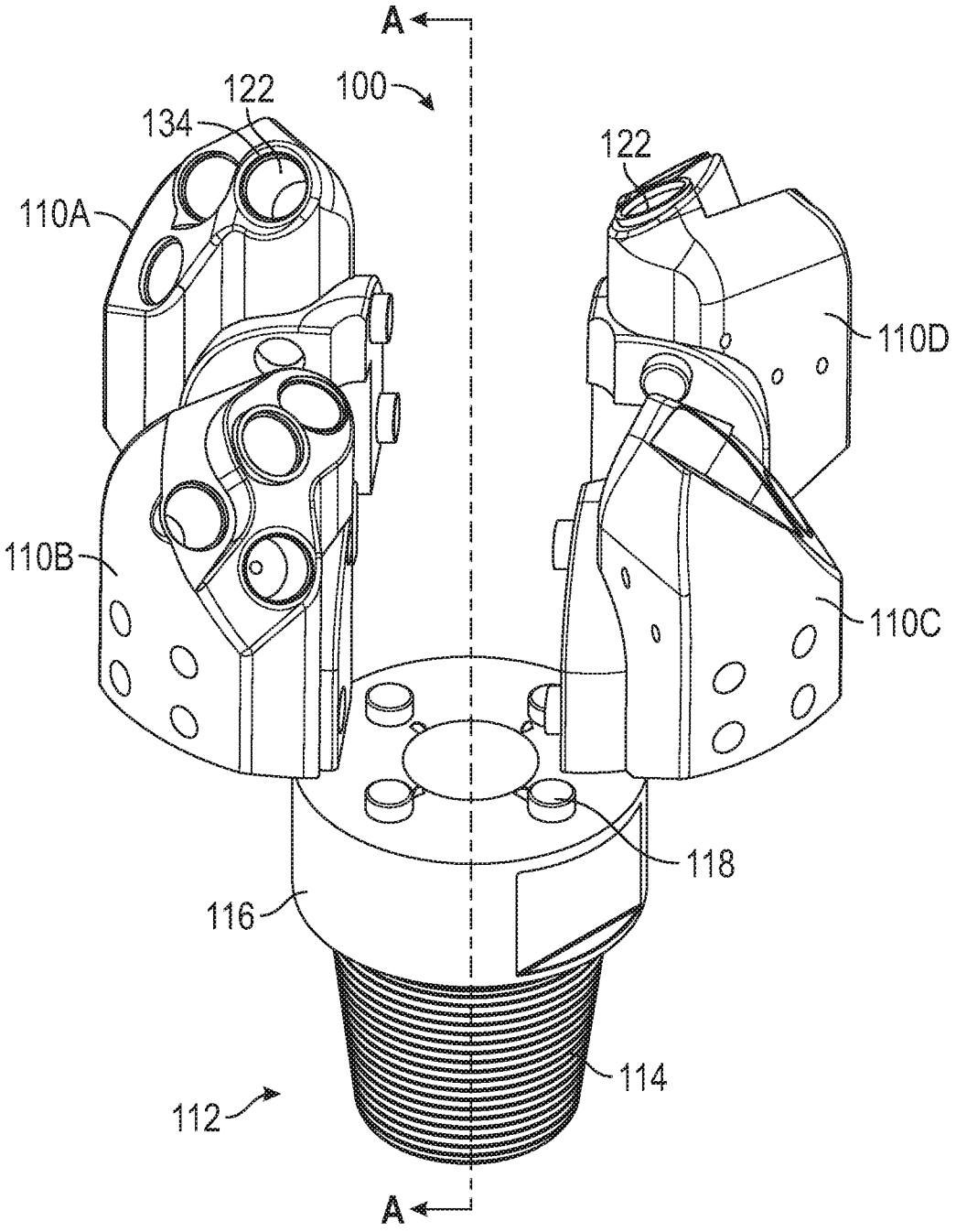
FIGS. 3 and 4 are partially exploded views of the drill bit assembly of FIG. 1 showing engagement of the blade members and the connector body.

Referring to FIGS. 2 and 3, the cutting blade 110 includes a plurality of blade members 110A, 110B, 110C, 110D configured to nest circumferentially around the centreline axis A-A. In the embodiment shown blade members 110A and 110C are configured to house three cutting pins 124, and blade members 110B and 110D are configured to house four cutting pins 124. It will be noted that the main difference between the three-pin and four-pin blade members is the number of cutting pins. Each blade member 110A, 1106, 110C, 110D, includes two engagement surfaces 126, 128 perpendicular to each other and extending radially from the centreline axis A-A. Each engagement surface 126, 128 is configured to engage a complementary engagement surface 126, 128 of an adjacent blade member 110A, 1106, 110C, 110D (see FIG. 4). For example, a first engagement surface 126 includes protrusions 130, and a second engagement surface 128 includes recesses 132. The blade members are configured so that the first engagement surface 126 of one blade member engages the second engagement surface 128 of an adjacent blade member. Each of the blade members 110A, 1106, 110C, 110D are engaged and nested to form the cutting blade 110. As shown in FIG. 19 the distance $D_1$ between respective outer surfaces, or gage pads, of opposing blade members (such as 110A and 110C or 1106 and 110D) is generally equal to the diameter $D_2$ of a wellbore to be drilled by the drill bit assembly 100. Advantageously, the distance $D_1$ may be varied by adjusting the nesting engagement of the blade members 110A, 1106, 110C, 110D and their mounting location on the connector body 112. As a result, the same set of blade members 110A, 1106, 110C, 110D can be used for fabrication of drill bit assemblies in a range of working diameters. Unlike the presently described drill bit assembly 100, prior art drill bits are typically fabricated for use in only one given diameter which can increase expenses associated with manufacturing and maintenance of such drill bits. For example, each blade member 110A, 1106, 110C, 110D may include gage inserts (not shown) for spacing the blade members apart thus increasing the diameter $D_1$. The gage inserts may be made, for example, from a hard or superhard material such as polycrystalline diamond, cubic boron nitride, diamond impregnated tungsten carbide or tungsten carbide.

Figure 4:
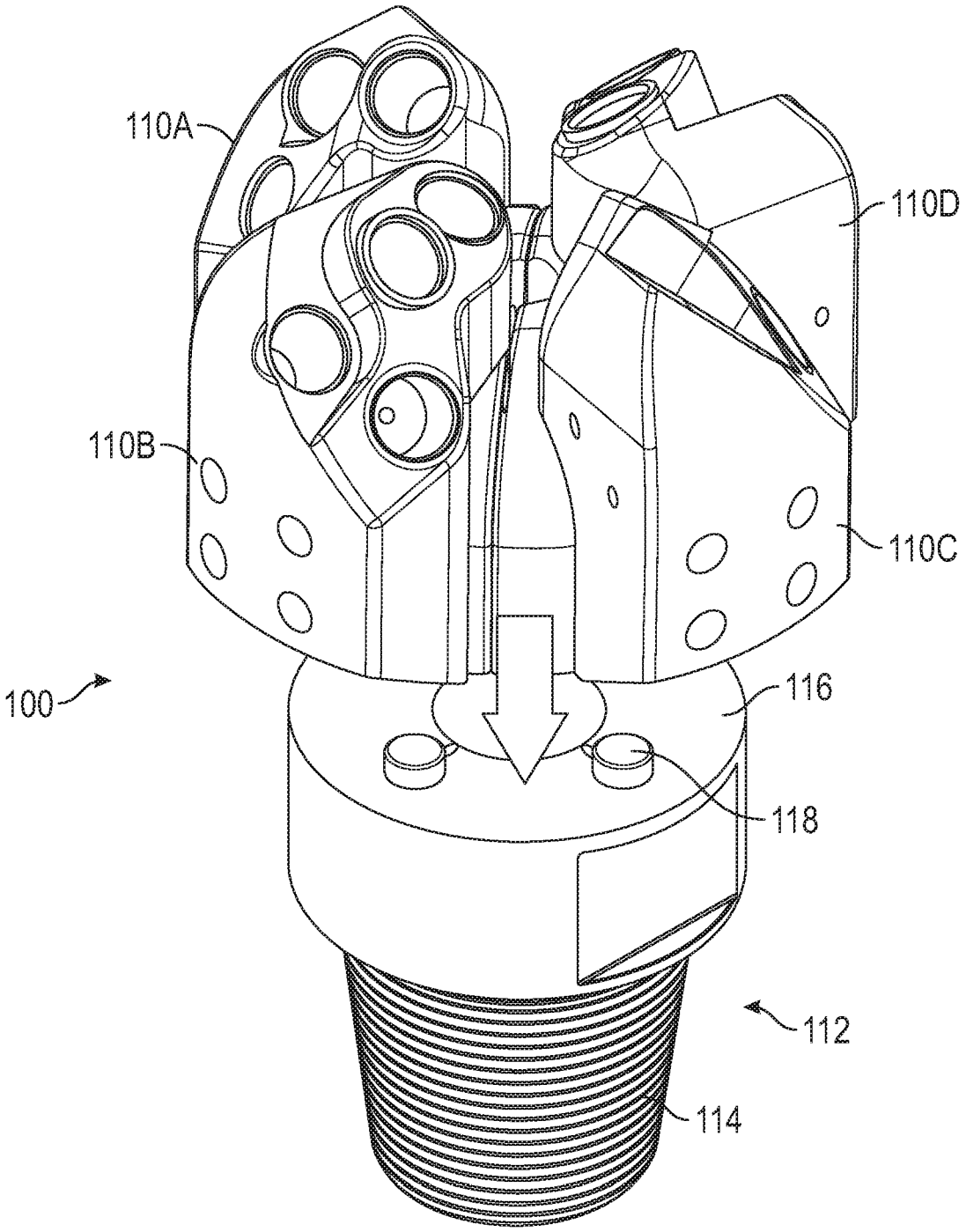
Figure 5:
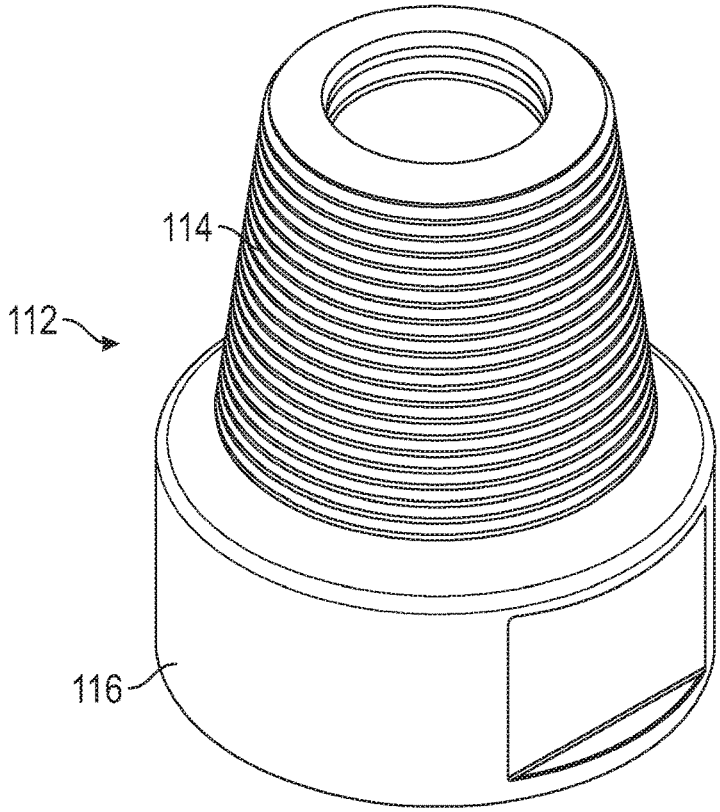
FIGS. 5 and 6 show the connector body for the drill bit assembly in FIG. 1.
Figure 6:
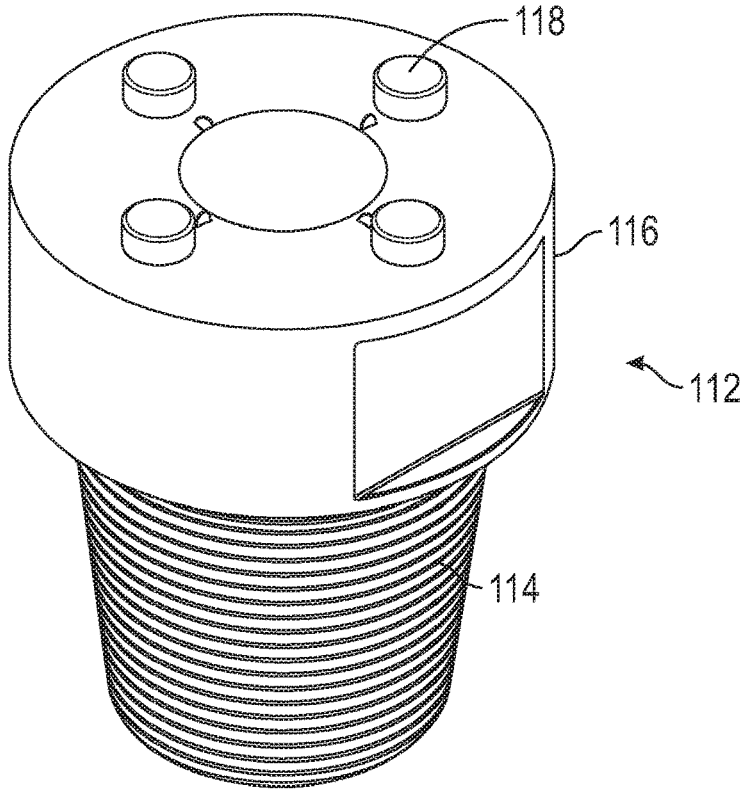
Figure 7:
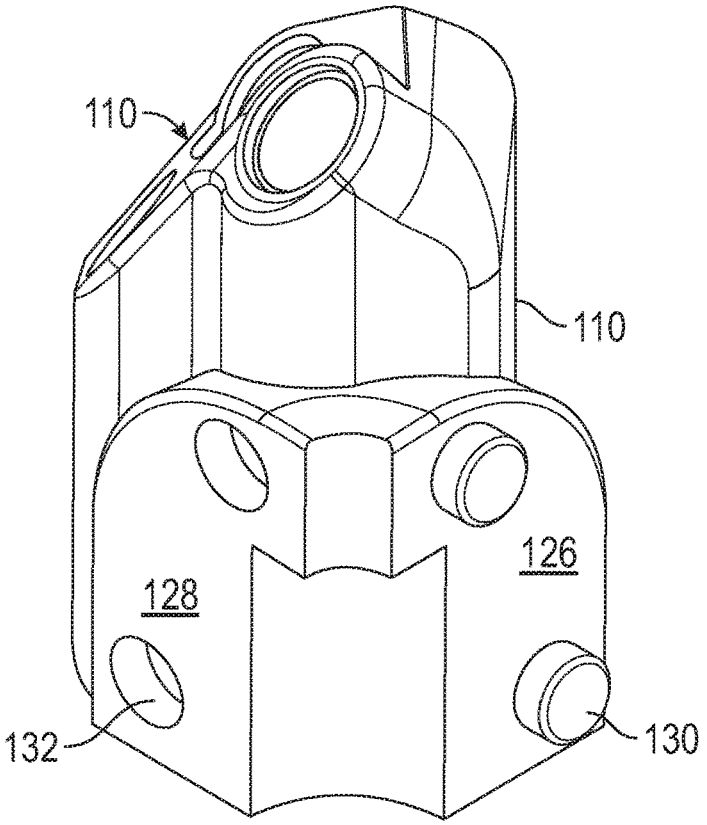
FIG. 7 shows a side view of a blade member for the drill bit assembly in FIG. 1.
Figure 8:
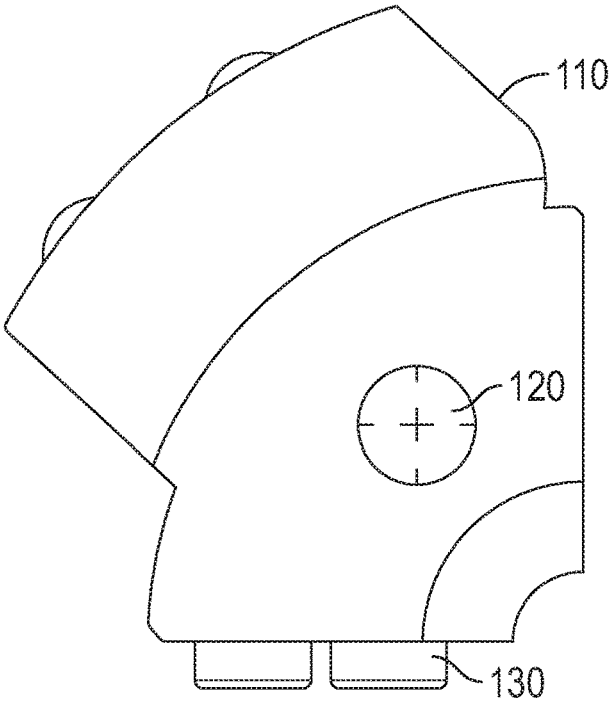
FIG. 8 shows a bottom view of the blade member of FIG. 7.
Figure 9:
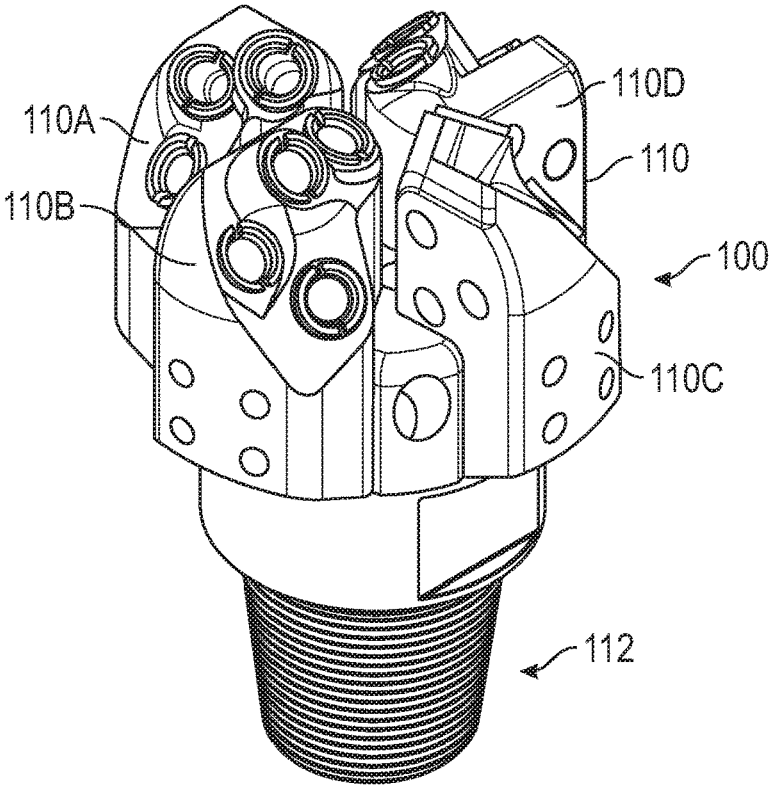
FIG. 9 shows a drill bit assembly according to a second embodiment of the present invention.
Figure 10:
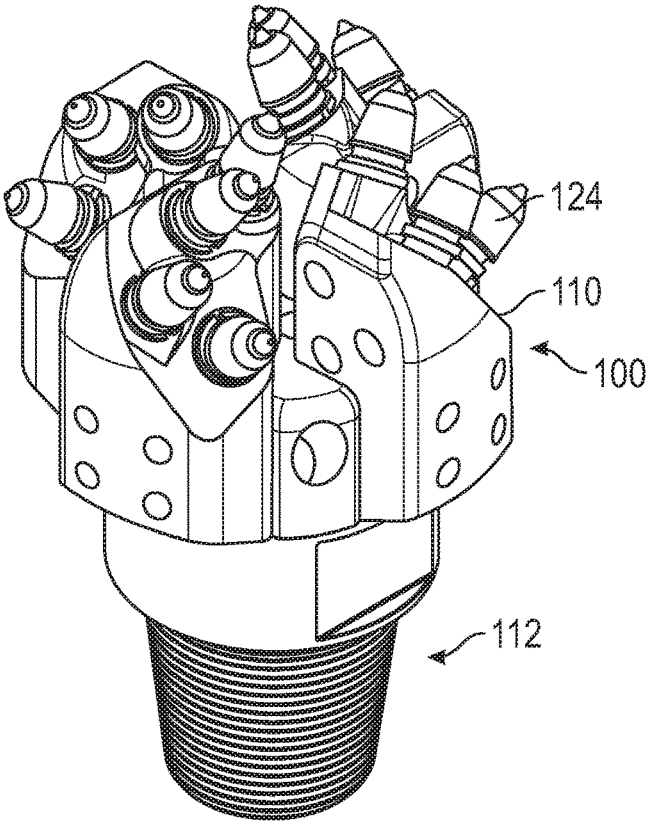
FIG. 10 shows the drill bit assembly of FIG. 9 with cutting pins.

FIG. 4 shows how each blade member 110A, 1106, 110C, 110D connects to the connector body 112. As shown in FIG. 6, the base portion 116 of the connector body 112 includes protrusions 118 which are received in corresponding recesses 120 in the underside of each blade member (see FIG. 8). The location of the protrusions 118 may be varied to provide a suitable working diameter $D_1$ for the assembled drill bit assembly 100. By way of example, if the protrusions 118 are located closer to the centreline axis A-A then it can be expected that the overall distance between respective outer surfaces, or gage pads, for opposite pairs of blade members 110A, 110C, or 110B, 110D, would be smaller relative to another scenario where the protrusions 118 are located further away from the centreline axis A-A of the connector body 112. It is understood that, alternatively, each blade member 110A, 110B, 110C, 110D may include the protrusions 118 and the connector body 112 may include the recesses 120.

Alternatively, as described in detail below the connector body 112 may include an adaptor 136 for positioning the blade members 110A, 110B, 110C, 110D to achieve the desired diameter wellbore. The adaptor 136 may be a separate piece, or integral with the connector body 112.

Edges of the engagement surfaces 126, 128 may include filleted or chamfered edge portions for welding the chamfered edges of adjacently positioned blade members once their position has been set for achieving a desired working diameter. Any gaps between the chamfered edges of adjacent blade members may be filled with welding material to achieve wafer bonding.

FIGS. 9 to 13 show a drill bit assembly 110 having an adaptor 136. Similar to the drill bit assembly described above, the drill bit assembly 110 in FIGS. 9 to 13 includes a connector body 112 having a centreline axis A-A, and a plurality of blade members 110A, 110B, 110C, 110D forming a cutting blade 110. The cutting blade 110 houses a plurality of removable sleeves 134, and each sleeve 134 is configured to receive a respective cutting pin 124. Additionally, the drill bit assembly 110 includes an adaptor 136 mountable to the connector body 112 and configured to position the blade members 110A, 1106, 110C, 110D to achieve the desired well bore diameter $D_2$.

Figure 11:
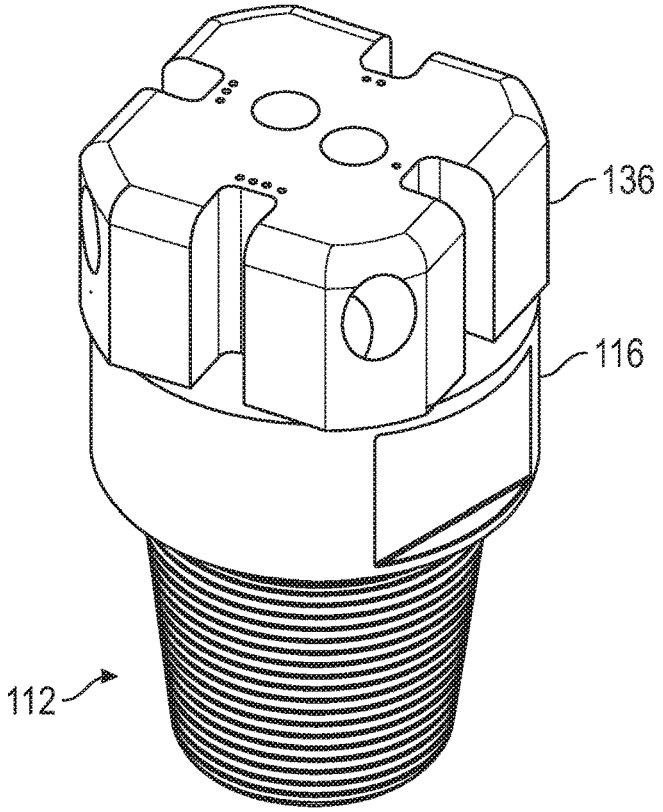
FIG. 11 shows a connector body for the drill bit assembly shown in FIG. 9.

Referring to FIG. 11, the adaptor 136 includes a plurality of slots, or grooves 138, for receiving and positioning the blade members 110A, 1106, 110C, 110D to achieve the desired outer diameter $D_1$. In the embodiment shown, the adaptor 136 is generally rectangular shaped and includes a slot or groove 138 to accommodate four blade members. It will be understood that more or fewer blade members may be used, and the number of slots or grooves adjusted accordingly.

Figure 12:
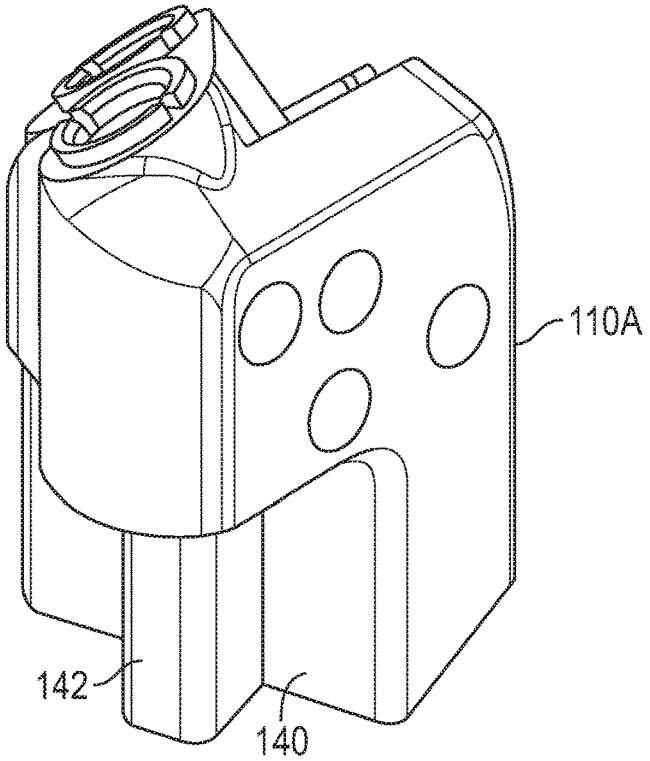
FIG. 12 shows a cutting blade for the drill bit assembly shown in FIG. 9.
Figure 13:
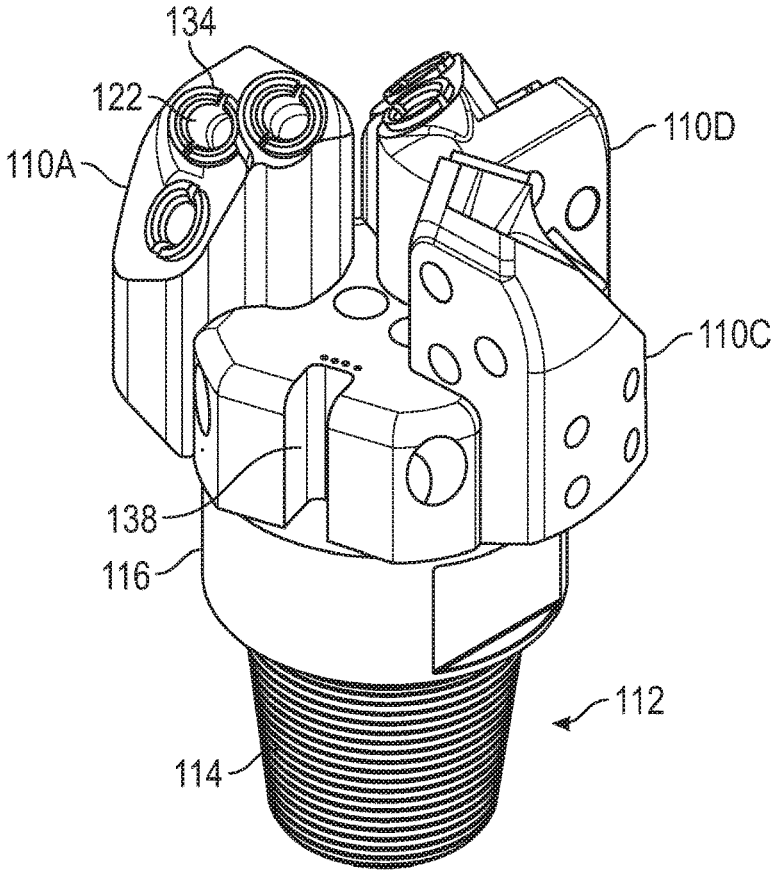
FIG. 13 shows the drill bit assembly in FIG. 9 having one cutting blade removed.
Figure 14:
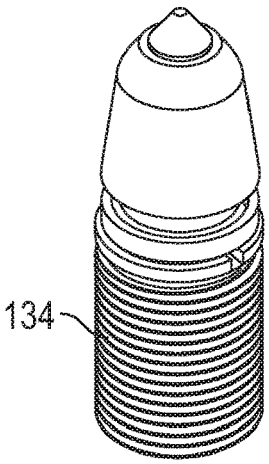
FIG. 14 shows a perspective view of a cutting pin and removable sleeve for the drill bit assembly.

Referring to FIG. 12, each blade member 110A, 1106, 110C, 110D includes a lower recessed surface 140 and a tongue portion 142 extending downwardly and outwardly from the lower recess surface 140. The tongue portion 142 is configured to be received in the recess or groove 138 of the adaptor 136. The distance $D_1$ between outer surfaces, or gage pads, of opposing blade members 110A, 1106, 110C, 110D may be determined by the depth of the tongue portion 142 and the length of the recess or groove 140. The adaptor 136 allows for the same connector body 112 and cutting blade 110 to be used to achieve different diameter well bores.

Figure 15:
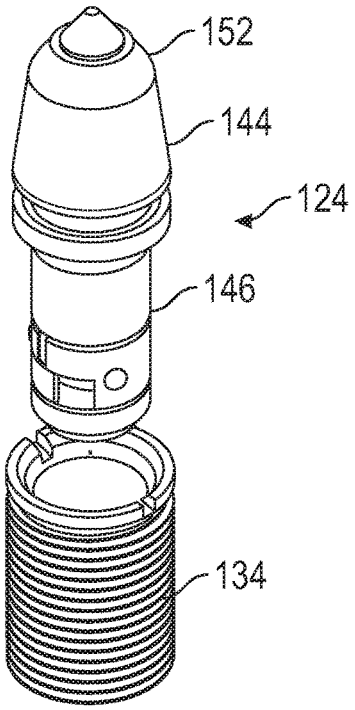
FIG. 15 shows the cutting pin and a removable sleeve.

FIGS. 14 to 18 show a cutting pin 124 and removable sleeve 134 to be used with the drill bit assembly 100 described above. The cutting pin 124 and removable sleeve 134 are housed in aperture 122 of the blade members 110A, 1106, 110C, 110D. Referring to FIG. 15, the cutting pin 124 may include a cone shaped body 144 terminating at a tip portion 152 and a mounting post 146 extending away from the body 144. The cutting pin 124 may be made from steel or similar high strength metal. At least a portion of the cutting pin 124, in this case, the mounting post 145, is receivable within the removable sleeve 134 (see FIG. 14). The skilled addressee will understand that the cutting pin 124 is configured to be rotatable within the removable sleeve 134 just as it would be rotatable within the aperture 122. The mounting post 146 may have a smaller diameter than the cutter body 144, as shown in this embodiment, so that the cutting pin 124 and the removable sleeve 134 form a consistent profile. The removable sleeve 134 includes external threads for engagement with internal threads within the apertures 122. Advantageously, the helical threads provided on the removable sleeve 134 have a configuration whereby the general direction of rotation to threadedly engaged to effect axial movement and insertion of the removable sleeve 134 into the aperture 122 is such that rotation of the drill bit assembly 100 about the centreline axis A-A does not result in the removable sleeve 134 becoming uncoupled from the blade member. As the drill bit assembly 100 rotates the cutting pins 124 also rotate within the removable sleeve 134 as the cutting blade 110 drags across the bottom of the well, scraping or shearing the formation. When the wear on the removable sleeve caused by the rotation of the cutting pins 124 eventually causes the cutting pins 124 to come loose and fall out rather than having to replace the entire blade member 110, only the removable sleeve 134 needs to be replaced.

Figure 16:
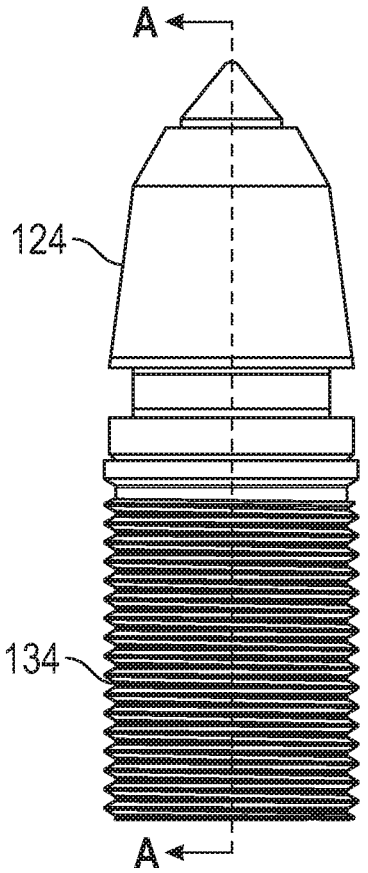
FIG. 16 shows a side view of the cutting pin.
Figure 17:
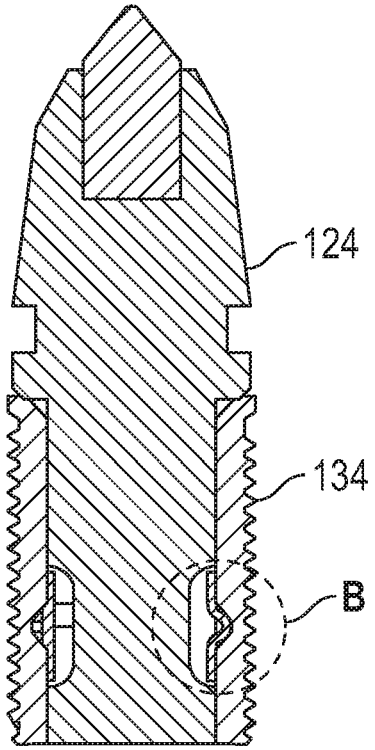
FIG. 17 shows a section view through A-A of the cutting pin in FIG. 16.
Figure 18:
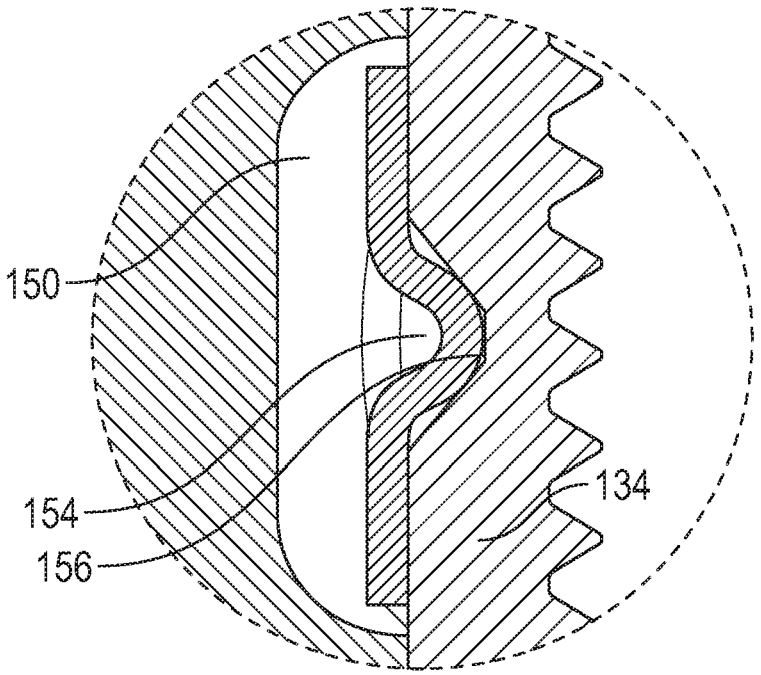
Figure 19:
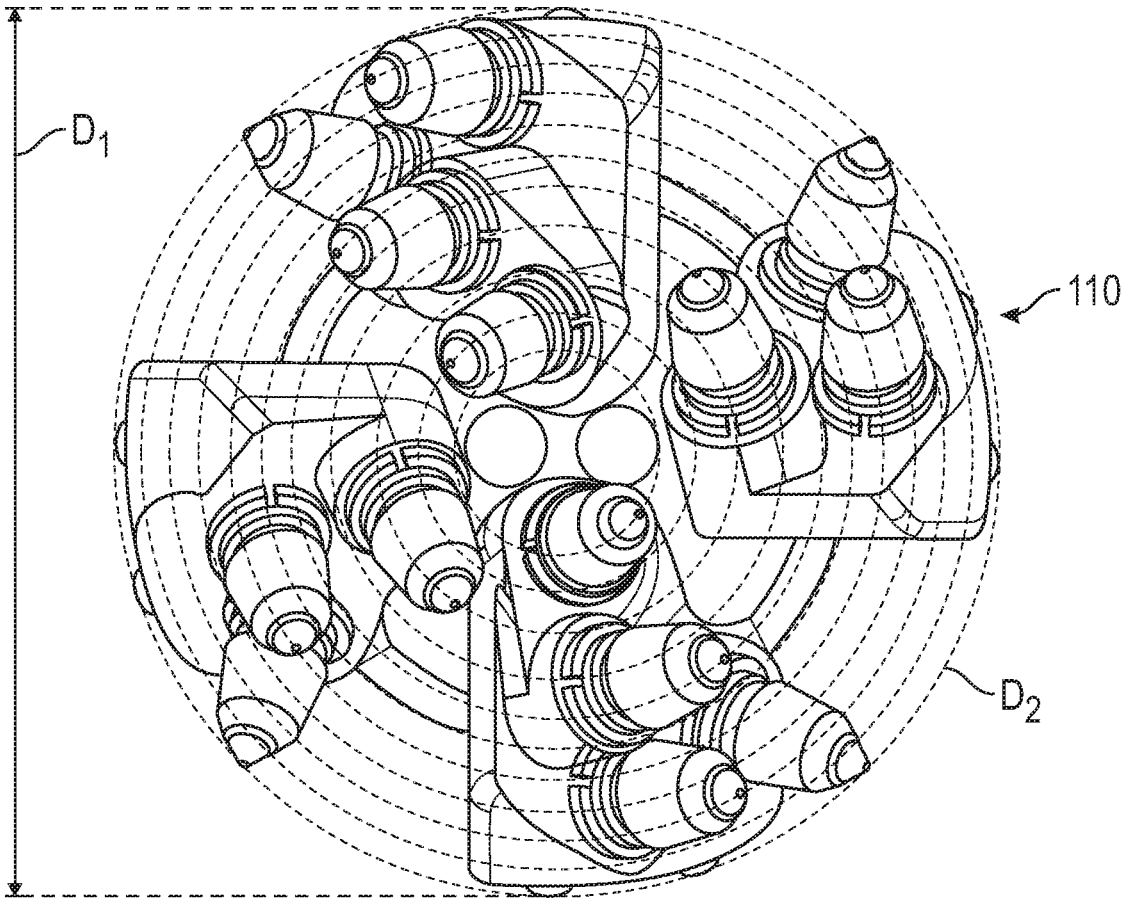
FIG. 19 shows the bore diameter in relation to the positioning of the blade members of the drill bit assembly.

Referring to FIGS. 16, 17 and 18, the mounting post 146 may include a reduced diameter recess 148 in which may be disposed a snap ring 150 having a spring lock 154 which prevents the cutting pin 124 from falling out of the removable sleeve 134 when in a non-use position and still allowing the cutting pin 124 to rotate within the removable sleeve 134 during use. The cutting pin 124 can be extracted from the removable sleeve 134 using screwdriver or other suitable tool. In some embodiments, the cutting pin 124 extends about 0.5 inches (13 mm) beyond a cutting surface defined by shear cutters. A range of such extension between ⅛ inch (3 mm) and ¾ inch (19 mm) is within the scope of the present disclosure.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A drill bit assembly for making a hole in a subterranean formation the drill bit assembly comprising:

a connector body defining a centerline axis about which said connector body rotates while drilling;

a plurality of blade members mounted to the connector body and circumferentially arranged around the centerline axis to form a cutting blade having an outer diameter generally equal to a desired hole diameter, wherein each blade member comprises at least one aperture configured to receive a cutting pin; and a removable sleeve positioned within the at least one aperture, the removable sleeve configured to rotatably engage with the cutting pin to allow the at least one cutting pin to rotate within the removable sleeve to minimize wear at a point of engagement of the cutting pin, when the drill bit assembly operates to make the hole in the subterranean formation, wherein the blade members are configured to nest circumferentially around the centerline axis to form the cutting blade, wherein the outer diameter of the cutting blade is configured to be variable by adjusting a mounting position of each of the blade members on the connector body to adjust a nesting configuration of the blade members, positioning at least one protrusion into at least one complementary recess, bringing the blade member into an engagement position, and wherein each of said blade members includes a first engagement surface and a second engagement surface perpendicular to the first engagement surface, and wherein the blade members are configured so that the first engagement surface of one blade member engages a second engagement surface of an adjacent blade member.

2. The drill bit assembly in accordance with claim 1, wherein the removable sleeve includes a connecting arrangement for securing the removable sleeve within the at least one aperture.

3. The drill bit assembly in accordance with claim 2, wherein the connecting arrangement includes an outer threaded surface on the removable sleeve, and an inner threaded surface within the at least one aperture so that the removable sleeve threadingly engages the at least one aperture.

4. The drill bit assembly of claim 1, wherein the first engagement surface includes a second at least one protrusion, and the second engagement surface of the adjacent blade member includes a second at least one complementary recess for receiving the second at least one protrusion of the first engagement surface of the blade member for engagement of the adjacent blade members.

5. The drill bit assembly in accordance with claim 1, further including an adaptor for selectively positioning the blade members circumferentially around the centerline axis.

6. The drill bit assembly in accordance with claim 5, wherein the adaptor includes a plurality of grooves circumferentially positioned around the centerline axis and wherein each groove is configured to receive one of the plurality of blade members.

7. The drill bit assembly in accordance with claim 6, wherein each of the plurality of blade members includes a tongue portion receivable within a respective groove.

8. The drill bit assembly of claim 1, further comprising a cutting pin, the cutting pin having a leading tip portion for cutting into the subterranean formation and a trailing portion for coupling with the removable sleeve, wherein the removable sleeve is configured to rotatably engage with the cutting pin to allow the cutting pin to rotate within the removable sleeve when the drill bit assembly operates to make the hole in the subterranean formation.

9. The drill bit assembly of claim 1, wherein the removable sleeve comprises an inner surface configured to receive the cutting pin and the inner surface comprises a recess configured to receive a lock of the cutting pin.

10. The drill bit assembly of claim 9, wherein the recess is configured to block an axial movement of the cutting pin relative to the removable sleeve along a longitudinal extension of the removable sleeve and allow a rotation of the cutting pin relative to the removable sleeve about a rotational axis extending in the longitudinal extension of the removable sleeve.

11. The drill bit assembly of claim 1, wherein the removable sleeve is formed as an integral piece.

12. The drill bit assembly of claim 1, wherein the removable sleeve is tubular and the removable sleeve comprises an inner surface and an outer surface, wherein the inner surface of the removable sleeve is configured to receive the cutting pin at a mounting post having a smaller diameter than a cutter body such that the cutting pin and the removable sleeve form a consistent profile.

13. The drill bit assembly of claim 12, wherein an inner diameter of the removable sleeve is generally constant over a longitudinal extension of the tubular removable sleeve, and an outer diameter of the tubular removable sleeve includes external threads while being generally constant over the longitudinal extension of the tubular removable sleeve.

14. The drill bit assembly of claim 1, wherein the cutting pin comprises a mounting post, wherein the mounting post comprises a recess, wherein a snap ring comprising a spring lock is arranged in the recess of the mounting post, and wherein the spring lock interlocks with the removable sleeve allowing a rotation of the cutting pin relative to the removable sleeve about a rotational axis extending in a longitudinal extension of the cutting pin and locking an axial movement of the cutting pin relative to the removable sleeve in the direction of the longitudinal extension of the cutting pin.

15. The drill bit assembly of claim 1, wherein the removable sleeve and the cutting pin are configured such that during use of the drill bit assembly the removable sleeve wears out by rotation of the cutting pin within the removable sleeve faster than the blade member wears out.

16. A drill bit assembly for making a hole in a subterranean formation, comprising:

a connector body defining a centerline axis about which said connector body rotates while drilling; and a plurality of blade members mounted to the connector body and circumferentially arranged around the centerline axis to form a cutting blade having an outer diameter generally equal to a desired hole diameter, wherein each blade member comprises at least one aperture configured to receive a cutting pin, and a removable sleeve positioned within the at least one aperture, the removable sleeve configured to rotatably engage with the cutting pin to allow the at least one cutting pin to rotate within the removable sleeve to minimize wear at a point of engagement of the cutting pin, when the drill bit assembly operates to make the hole in the subterranean formation, wherein the outer diameter of the cutting blade is configured to be variable by adjusting a mounting position of each of the blade members on the connector body to adjust the circumferential arrangement of the plurality of blade members to allow the drill bit assembly to be used at variable diameters;

wherein the blade members are configured to nest circumferentially around the centerline axis to form the cutting blade; and wherein each blade member includes a first engagement surface and a second engagement surface perpendicular to the first engagement surface, and wherein the blade members are configured so that the first engagement surface of one blade member engages a second engagement surface of an adjacent blade member.

17. The drill bit assembly of claim 16, further including an adaptor for coupling the connector body and the blade members, wherein the adaptor positions the blade members to achieve the cutting blade outer diameter equal to the desired hole diameter.

18. The drill bit assembly of claim 17, wherein the adaptor includes a plurality of grooves circumferentially spaced apart and configured to receive a respective blade member.

19. The drill bit assembly of claim 18, wherein each blade member includes a tongue portion receivable within a respective groove for engagement with the adaptor.

20. The drill bit assembly of claim 16, wherein the connector body comprises at least one protrusion and at least one of the plurality of blade members comprises at least one recess, and the at least one protrusion is received in the at least one recess.

21. The drill bit assembly of claim 20, wherein the at least one protrusion is positioned at a base portion of the connector body and extends in a direction towards the plurality of blade members.

22. The drill bit assembly of claim 20, wherein the at least one recess is formed in an underside of the respective blade member.

23. The drill bit assembly of claim 20, wherein a variation of a location of the at least one protrusion varies the outer diameter of the of the cutting blade.

* * * * *